US009713832B2

(12) United States Patent
Schollhammer

(10) Patent No.: US 9,713,832 B2
(45) Date of Patent: Jul. 25, 2017

(54) DRAWING PRESS WITH DYNAMICALLY OPTIMIZED BLANK HOLDING

(75) Inventor: Dietmar Schollhammer, Goppingen (DE)

(73) Assignee: Schuler Pressen GmbH, Goppingen (DE)

( * ) Notice: Subject to any disclaimer, the term of this patent is extended or adjusted under 35 U.S.C. 154(b) by 296 days.

(21) Appl. No.: 13/866,107

(22) PCT Filed: Oct. 14, 2011

(86) PCT No.: PCT/EP2011/068041

§ 371 (c)(1),
(2), (4) Date: Aug. 19, 2013

(87) PCT Pub. No.: WO2012/062532

PCT Pub. Date: May 18, 2012

(65) Prior Publication Data

US 2013/0333437 A1 Dec. 19, 2013

(30) Foreign Application Priority Data

Oct. 21, 2010 (DE) ..... 10 2010 060 103

(51) Int. Cl.
*B21D 22/20* (2006.01)
*B21D 22/22* (2006.01)
(Continued)

(52) U.S. Cl.
CPC ..... *B21D 22/20* (2013.01); *B21D 22/22* (2013.01); *B21D 24/12* (2013.01); *B30B 1/14* (2013.01);
(Continued)

(58) Field of Classification Search
CPC ..... B21D 22/20; B21D 22/22; B21D 24/12; B21D 24/10; B21D 22/206; B21D 24/005;
(Continued)

(56) References Cited

U.S. PATENT DOCUMENTS 3,054,496 A 9/1962 Carter
4,969,348 A 11/1990 Clowes
(Continued)

FOREIGN PATENT DOCUMENTS

JP 2001062591 A * 3/2001
JP 2008100242 A * 5/2008

OTHER PUBLICATIONS

Machine Translation of the Descriptiojn section of JP 2008-100242 from Espacnet.com.*
(Continued)

*Primary Examiner* — Peter DungBa Vo
*Assistant Examiner* — Joshua D Anderson
(74) *Attorney, Agent, or Firm* — R. S. Lombard

(57) ABSTRACT

The drawing press (10) according to the invention has for driving its ram (15) a directionally reversing gear mechanism (22, 54), for example a coupling gear mechanism, and at least one servomotor (23). The servomotor (23) passes through the reversal point (Ut) of the ram movement, which is predetermined by the kinematics of the coupling gear mechanism, for example the extended position of an eccentric drive. During the closing of the die (18), that is to say during a press stroke, the servomotor (23) is activated in such a way that it first passes through this reversal point (Ut), then stops, reverses and then passes through it once again, in order to open the die (18) again. Consequently, the braking to a standstill and re-acceleration of the servomotor for the upper ram (15) takes place while the actual drawing opera-
(Continued)

Figure 1:
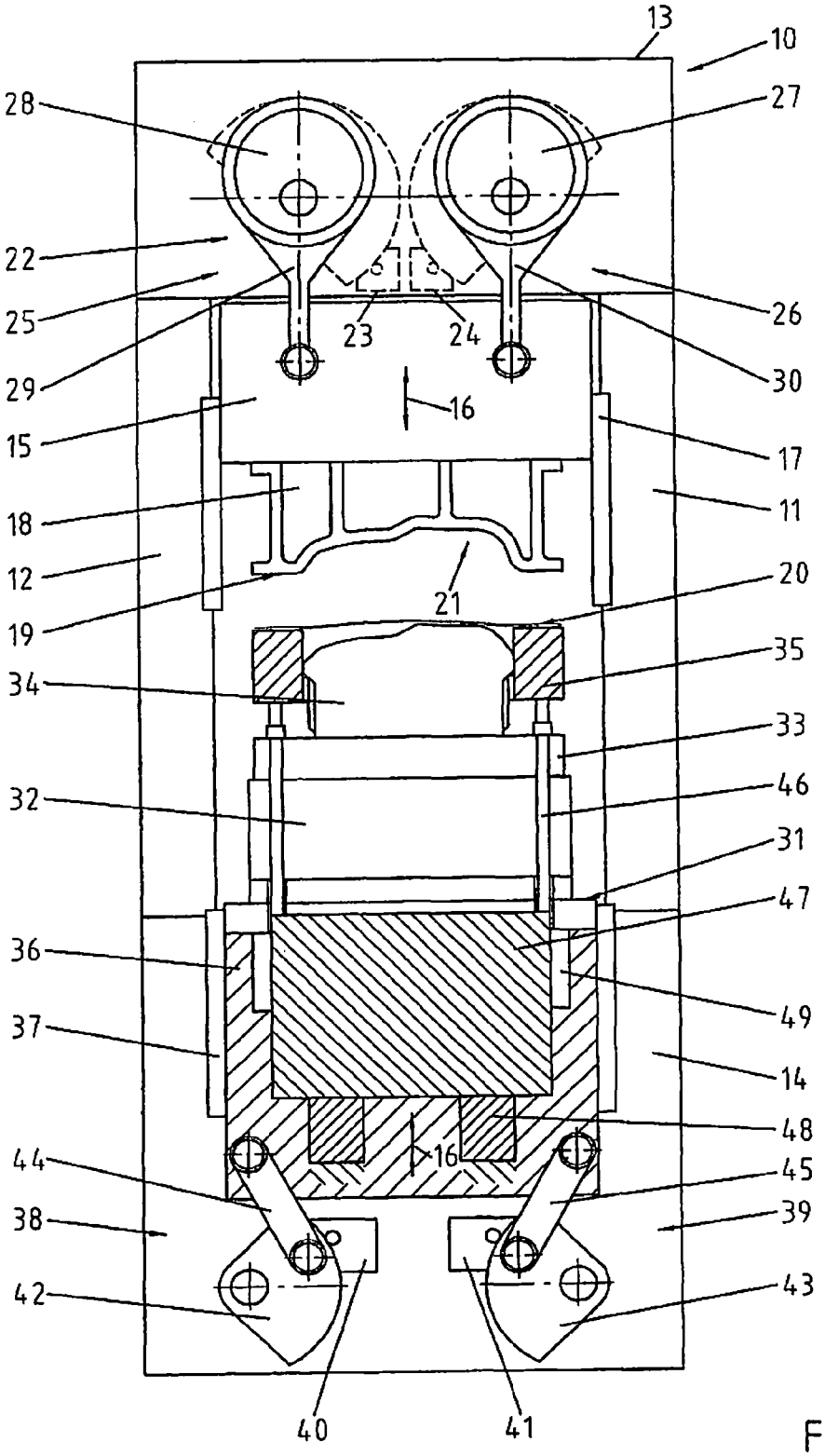

tion is still or already being performed, i.e. during the forming of the metal blank, which significantly reduces the cycle time.

12 Claims, 5 Drawing Sheets

(51) Int. Cl.

| | |
|---|---|
| ***B21D 24/12*** | (2006.01) |
| ***B30B 1/14*** | (2006.01) |
| ***B30B 1/26*** | (2006.01) |
| ***B30B 1/28*** | (2006.01) |
| ***B30B 15/14*** | (2006.01) |
| *B30B 15/20* | (2006.01) |

(52) U.S. Cl.
CPC ..... *B30B 1/261* (2013.01); *B30B 1/266* (2013.01); *B30B 1/28* (2013.01); *B30B 15/148* (2013.01); *B30B 15/20* (2013.01)

(58) Field of Classification Search
CPC .. B30B 1/14; B30B 1/26; B30B 1/266; B30B 1/261; B30B 1/28; B30B 15/148; B30B 15/14; B30B 15/144; B30B 15/146; B30B 15/18; B30B 15/20; B30B 15/281
USPC ..... 72/347, 350, 351, 379.2, 454, 452.4, 72/452.5, 349
See application file for complete search history.

(56) References Cited

U.S. PATENT DOCUMENTS

| | | | | |
|---|---|---|---|---|
| 7,353,685 | B2 * | 4/2008 | Martin et al. | 72/450 |
| 7,434,505 | B2 * | 10/2008 | Suzuki et al. | 100/43 |
| 2005/0274243 | A1 * | 12/2005 | Shiroza et al. | 83/13 |
| 2007/0062247 | A1 * | 3/2007 | Hofele et al. | 72/441 |
| 2007/0240479 | A1 * | 10/2007 | Nagai et al. | 72/348 |
| 2009/0090161 | A1 * | 4/2009 | Amino | 72/453.12 |

OTHER PUBLICATIONS

Machine translation of description section of JP 2001-062591 provided by JPO website (JPlatPat).*
PCT/EP2011/068764, International Search Report.
Schuler; Metal Forming Handbook.
Mexican Office Action; dated Jul. 6, 2016.

* cited by examiner

DRAWING PRESS WITH DYNAMICALLY OPTIMIZED BLANK HOLDING

CROSS REFERENCE TO RELATED APPLICATION

The present patent application is based upon and claims the benefit of PCT/EP2011/068041, filed Oct. 14, 2011; which is based on German patent application no. 10 2010 060 103.9; filed Oct. 21, 2010.

FIELD OF THE INVENTION

The invention relates to a drawing press that is suitable, in particular, for the integration of press facilities, press lines, hybrid press plants or transfer presses for the manufacture of vehicle body parts. The drawing press in accordance with the invention is particularly suitable for high stroke rates.

BACKGROUND OF THE INVENTION

In the manufacture of vehicle body parts or other large-surface, spatially formed sheet metal parts, the first press step, in most cases, uses a drawing press that imparts a so far plane blank with a three-dimensional form. This is accomplished in a drawing tool that holds the rim of the blank by clamping it in place, or that also allows it to slide in a controlled manner toward the center of the metal sheet, while the part of the metal sheet circumscribed by the sheet metal blank holder receives the desired three-dimensional form between a matrix and a punch.

Today, established drawing presses comprise a punch that is statically supported by a press table, and the associate matrix is held on the ram that can be moved vertically up and down. During the drawing operation, blank holder encloses the ram and is pressed downward by the rim of the matrix against the force of a drawing cushion. Referring to this basic configuration, the convexly curved sheet metal side is formed on the upper side of the sheet metal part, as is also desired for the subsequent press steps. During the subsequent press steps, in particular punching operations are also performed. In the case of vehicle body parts, it is necessary, as a rule, that the resultant punch burr be located on the hollow side, i.e., the concavely curved underside of the sheet metal part. Inasmuch as reversing stations and the like between the individual press steps must be considered unacceptable, the design form addressed here has established itself as the standard. Consequently, design forms with the matrix located on the bottom and the punch located on the top (as well as with the sheet metal holder located on the top) as have been known, for example, from publication DE 10117578 B4, are thus less frequently used.

Presses of the aforementioned type with the matrix at the top and the statically supported punch on the bottom have been known, for example, from publication DE 10 2006 025271 B3. In this press, the ram, as well as the drawing cushion, are driven by servomotors via spindle-type lifting gear. After each, the ram and the drawing cushion, performs a back and forth movement, the servomotors must perform a reversal of movement. The reversal of movement occurs at the respective dead center of the movement of the drawing cushion or of the ram. This means that the deceleration and acceleration phases of the servomotors noticeably extend the cycle time required for drawing a sheet metal part.

In addition, there is a considerable use of energy in such presses. Considerable force is required for depressing the blank holder, namely for overcoming the blank holding force. This force cannot be randomly reduced, on the contrary, it must increase with increasing sheet metal strength. Considering this design, the path to be traveled by the blank holder cannot either be randomly reduced because it essentially corresponds to the drawing depth and thus is prespecified by the geometric configuration of the workpiece. Even if the energy converted by the drawing cushion can optionally be re-supplied to a storage, a net or another user, energy losses are nearly inevitable.

SUMMARY OF THE INVENTION

Therefore, it is the object of the invention to provide a press design and a forming method that can be used for the manufacture of deep drawn components at a high stroke rate and with a low energy use, wherein a component orientation (i.e., an alignment of the components) is achieved as is desired for the subsequently succeeding press steps.

This object is achieved with the drawing press and with the method in accordance with the claims The drawing press in accordance with the invention usually comprises a press frame that may consist of one or more parts. It may comprise a head, a table and interposed stands. A ram for the accommodation of a matrix tool is provided, said ram being supported so as to be adjustable in an adjustment direction. At least one ram drive comprising at least one servomotor that is connected with the ram via a coupling gear mechanism and a cam mechanism is used for driving said ram. The coupling gear mechanism is understood to mean any gear mechanism, wherein a uniform rotary motion is converted into a periodically changeable motion. Consequently, said mechanism comprises at least one reversal point at which the generated linear motion is reversed without requiring the reversal of the direction of rotation of the driving servomotor. Alternatively, such motion characteristics can also be achieved with a cam mechanism that, e.g., comprises a rotating cam disk or a cam and a cam follower element that can move in linear direction.

Referring to the press in accordance with the invention, the ram assumes the reversal point $U_t$ at least at two points in time TA, TB, said points being spaced apart in view of time, during a single press stroke, while the servomotor is in operation and the matrix tool is closed. The concept of a closed tool is understood to mean that state in which the matrix tool is in contact with the workpiece, e.g., a sheet metal component.

Inasmuch as the reversal point is assumed at least twice dynamic advantages are achieved, said advantages making possible a significant increase of the press operating speed with a simultaneously reduced or equal machine load and optionally lower peak loads on all the involved servomotors. The ram drive is disposed to perform the closing movement and to generate the blank holding force. Instead of decelerating toward the reversal point, the deceleration of the servomotor is initiated with a delay in such a manner that an overrun takes place. The region of the overrun is preferably on an order of magnitude that results, for example, from an eight-member press drive with blank holder. Thus the forming operation, wherein the punch tool deforms the blank held at the rim, can clearly be started before the reversal point $U_t$ is reached, i.e., before the holding position of the ram is reached. Consequently, when the reversal point $U_t$ of the ram and the matrix tools is reached for the first time, it is possible to start the table drive assigned to the punch tool. Chronologically clearly before the upper end position of the table drive is reached, the servomotor accelerates the blank holding drive, i.e., the ram, in reverse direction of rotation in such a manner that the second reaching of the reversal point with the still closed matrix tool coincides at least approximately with the point in time when the movement end point of the table drive is reached. The movement end point of the table drive may be an extended position of its coupling elements if said drive is configured as a toggle mechanism or as an eccentric drive or as any other coupling gear mechanism.

On account of the presented mode of operation, the ram with the matrix tool, i.e., the blank holding drive, already has a starting rotational speed when the second reversal point is reached, said rotational speed accelerating the lifting of the matrix tool off the blank. In doing so, the open time of the tool is increased overall, so that, in turn, the press can operate overall faster again. In contrast with a mechanically equal press having the identical design, in which case the servomotor of the ram drive stops exactly at the point of reversal $U_t$, stroke rates that are clearly greater by 10% can be achieved.

Preferably, the table drive is also configured as a coupling gear mechanism whose elements are in the extended position when the upper end position is reached. Consequently, it is possible to use simply constructed eccentric gear mechanisms in the ram drive, as well as in the table drive. At the same time, the ram drive requires that only 200 degrees of the circumference of the drive wheel of the eccentric be provided with toothing. For the table drive, toothing of 120 degrees around the drive of the eccentric is sufficient. All around toothing of 360 degrees is not necessary. This clearly results in more cost-effective designs of the drives.

In addition, it is possible to adapt the driving regions of the servomotors of the ram drive and of the table drive in such a manner that one of the servomotors reclaims energy generatorically, said energy being supplied to a storage or to at least one of the servomotors of the respectively other drive in order to contribute there to the acceleration of the servomotor.

The presented concept allows the provision of a blank holder that may be supported, e.g., by a stationary abutment. This blank holder is non-moving relative to the punch tool that is moved into the matrix tool due to the movement of the table during the drawing operation. This is accomplished with the table drive. Inasmuch as the blank holder is in a rest position during the drawing operation, no or at least almost no energy is required for the application of the blank holding force. The ram bearing the matrix tool is held by the ram drive essentially in the vicinity of the reversal point $U_t$. Whereas this can be ideally accomplished with cam mechanisms and also without a movement reversal of the corresponding servomotor, this is achieved with the use of a coupling gear mechanism—in the extended position and with the servomotor decelerating and reversing—by the almost maintained extended position of the coupling elements. The movements of the ram occurring in moving direction are minimal and can be compensated for, e.g., by the elastic frame stretch of the press frame. Alternatively, it is possible to provide the abutment of the blank holder with a preferably short-stroke and hard springiness or with a force-regulating device, e.g., of a hydraulic or mechanical nature.

As has been explained, the ram drive preferably comprises at least one blocking position in which the forces acting on the ram are introduced into the press frame by at least largely—if not completely—bypassing the actual driving source, for example a servomotor. Eccentric gear mechanisms, toggle mechanisms, cam mechanisms or similar mechanisms may be used. In an eccentric gear mechanism, the extended position is that position in which the lever arm of the eccentric (connection line between the fulcrum of the eccentric and the center of the eccentric) is in alignment with the connected eccentric rod.

The table drive provides the punch stroke that is necessary to form the blank—preferably while the ram drive is in blocking position or another rest position. During the drawing operation, the matrix tool is at rest, in which case in particular the blank holding force is applied against the blank holder that is also at rest. Consequently, the blank holding force is preferably statically introduced into the press frame on the side of the ram and the matrix held by it, as well as also on the side of the blank holder, and need not be applied by any drives. This considerably lowers the power required for driving the ram as well as for driving the table. The power required for moving the ram is low. Apart from the power required for the dynamic acceleration and deceleration of the ram and the matrix, the ram drive must build up the blank holding force only one time after the matrix tool has been placed on the blank. This force is kept static by the press frame. Alternatively, the blank holding force may also be applied by a short-stroke blank holder drive. The blank holder drive may also comprise a blocking position. For example, it may be configured as a short-stroke eccentric drive or cam drive that tensions the blank holder against the rim of the matrix tool and directly introduces the tension forces into the press frame. Here, a blocking position is reached when the eccentric drive is in extended position or a cam drive is positioned in a maximum-radius cam section. In this case, a movement of the driving servomotor causes no or only a negligibly minimal blank holder movement.

For driving the table, it is only necessary to perform the forming work for the blank.

The presented press concept minimizes the power to be applied to the ram drive and the table drive and minimizes the energy exchange between these drives. To this extent, the press needs only smaller drives for the same output, compared with other presses wherein a more intense energy exchange takes place between the ram drive and the drawing cushion.

In addition, considering the presented press concept, the otherwise required total stroke of, e.g., 1300 mm is divided into two strokes, namely the stroke of the ram and the stroke of the table. While the stroke of the ram is mostly disposed for opening and closing the tool, the stroke of the table is disposed for moving the punch back and forth and thus for performing the actual drawing operation. The ram stroke, for example, may only be 100 mm and the table stroke, for example, only 300 or 400 mm. It is also for this reason that the ram drive may be smaller than a conventional drive.

The presented press concept allows the continued use of existing tool sets that were provided as such for the operation with the punch at rest and during the drawing operation of the downward moved blank holder. Also, it is possible to continue the use of conventional transfer devices without appreciable adaptation. Referring to the drawing press in accordance with the invention, the linearly movable table may comprise a group of passages through which extend abutment elements. These abutment elements, for example in the form of straight setbolts, extend through these passages and support the blank holder against an abutment. Preferably, the abutment is stationarily arranged relative to the press frame. This means that the position of the blank holder is stationary relative to the press frame or, optionally, is absolutely prespecified via an adjustment device. If the blank located on the blank holder is tensioned by the matrix relative to the blank holder and if the ram drive moves into blocking position (i.e., for example, its gearing mechanism into extended position), the blank holding force is determined by the frame stretch of the press frame. This frame stretch may be in the range of a few millimeters to a few 10 mm. The energy that is elastically stored in the press frame can be re-transferred to the ram drive during the reverse stroke of the ram, thus further reducing the gross energy use of the drawing press.

As has been mentioned, it is also possible to assign an adjustment drive of a hydraulic or mechanical nature to the abutment. For example, as mentioned hereinabove, the adjustment drive may be a short-stroke toggle mechanism or also an eccentric gear mechanism or the like. Typically, the adjustment stroke will also be a few 10 mm. This design is advantageous in particular if the ram drive performs a specific movement between the two points in time in which it is in its reversal position $U_r$, or if it can move only with low force into its blocking position and lock in there, as may be the case in a cam mechanism. In this case, the blank holding force can be applied by the short-stroke blank holder drive after the ram has been blocked. The adjustment stroke of the blank holder drive is then preferably as large as the total occurring frame stretch of the press frame.

Independently of each other, the ram drive, as well as the table drive, are preferably servomotor drives. The servomotors act on the ram and on the table, respectively, preferably via gear mechanisms that comprise at least one rest position. A rest position is a position, in which the reduction ratio between the servomotor and the ram or the table becomes very large or even infinite in at least one point. This applies to eccentric gear mechanisms, as well as to toggle mechanisms in the extended position of the involved elements. Multi-member gear mechanisms comprising several extended positions can advantageously be used.

IN THE DRAWINGS

Figure 2:
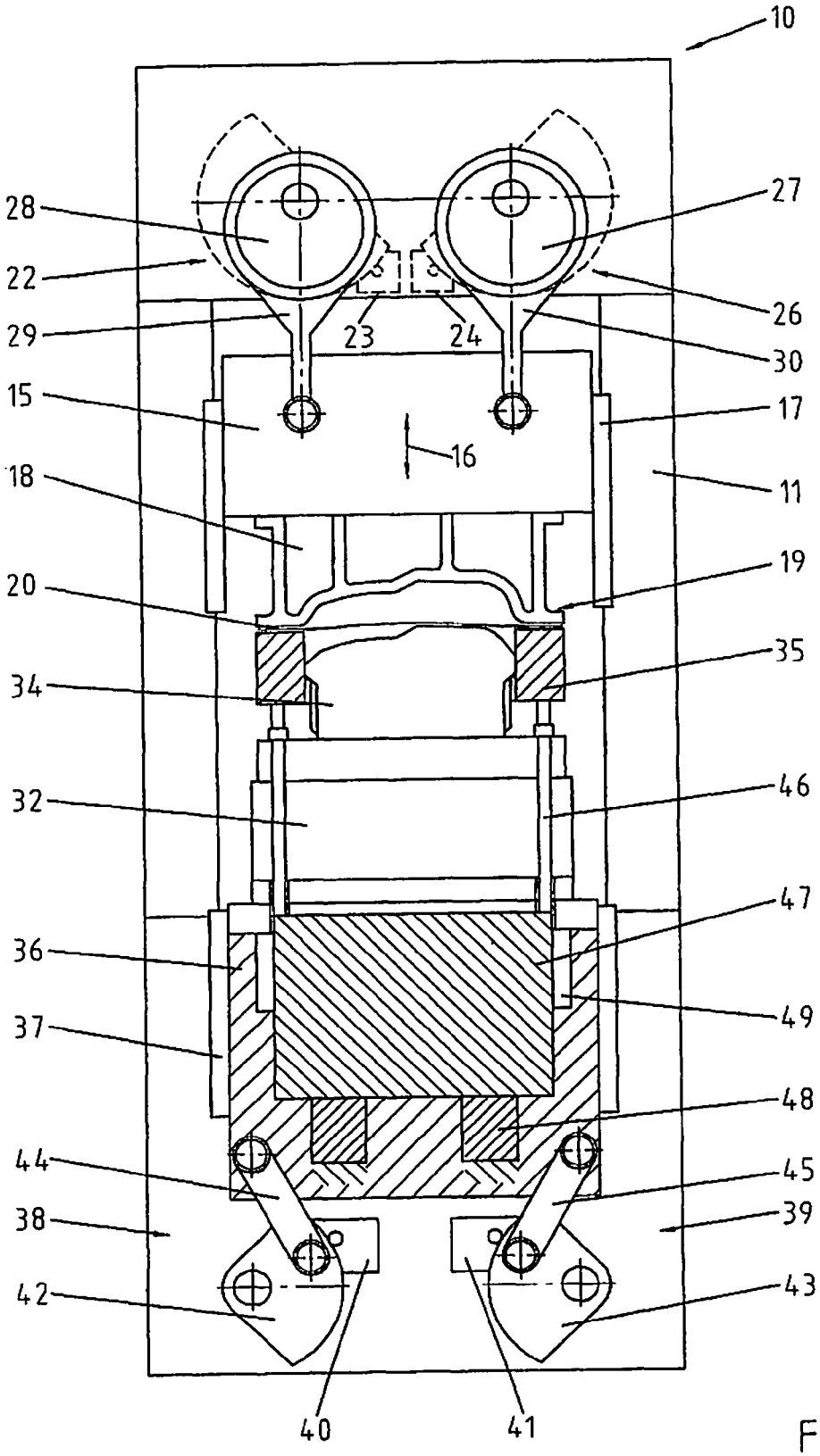
Figure 3:
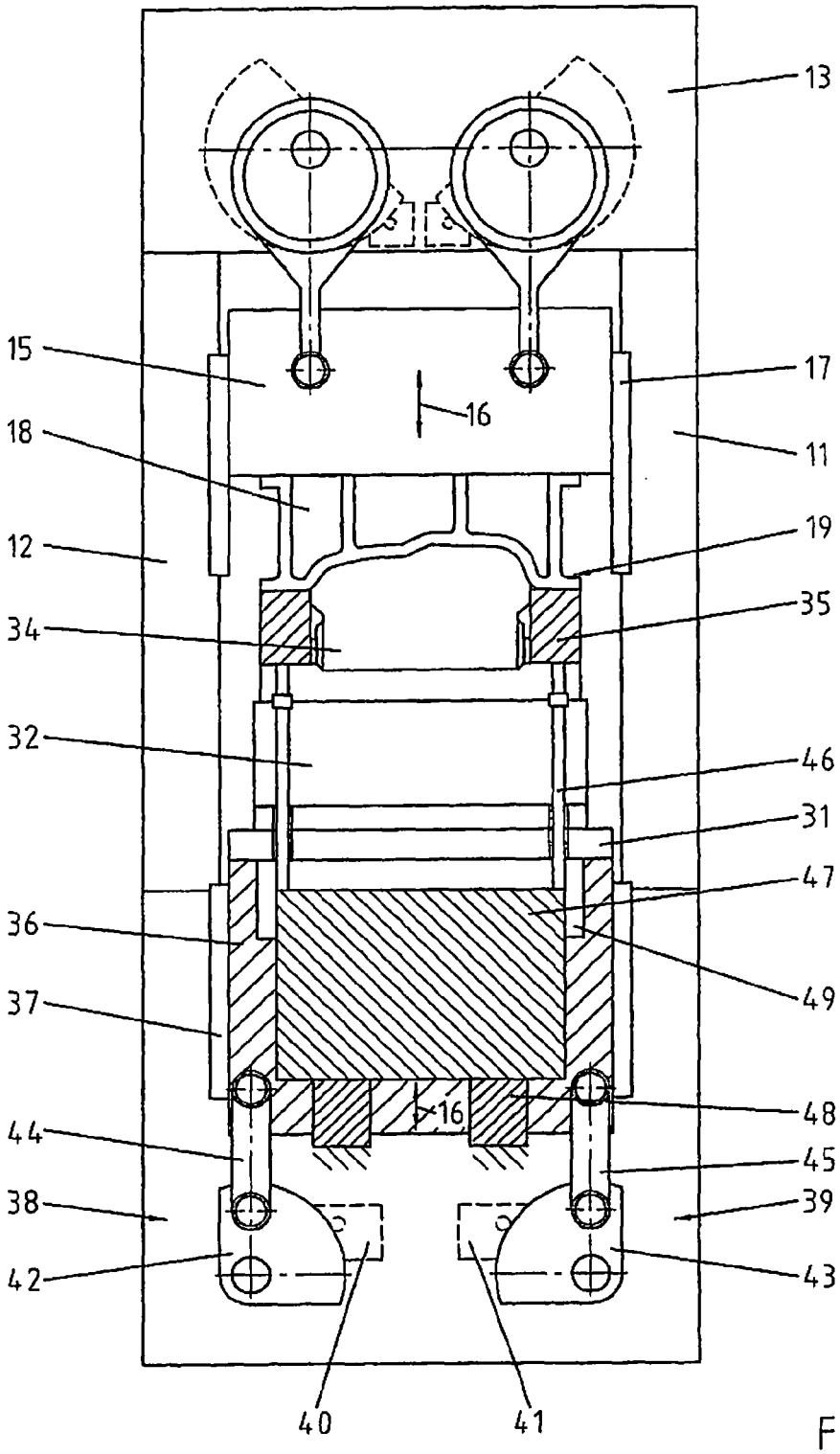
Figure 4:
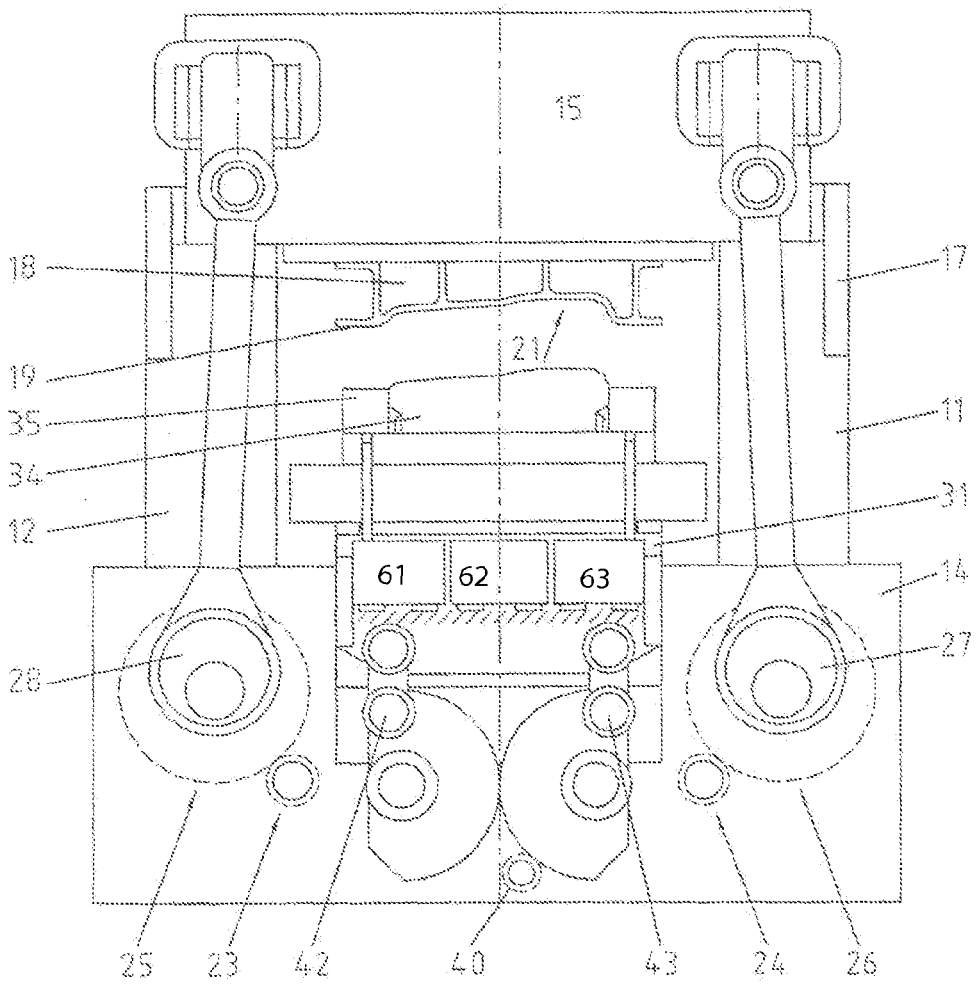
Figure 5:
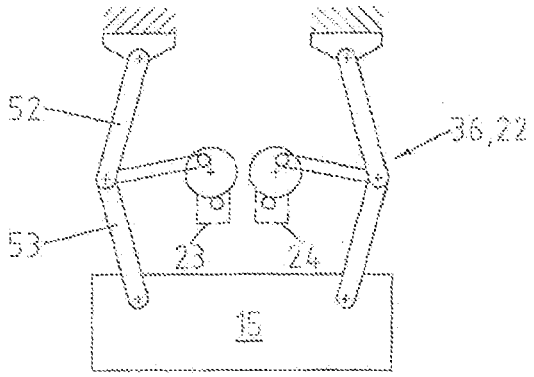
Figure 6:
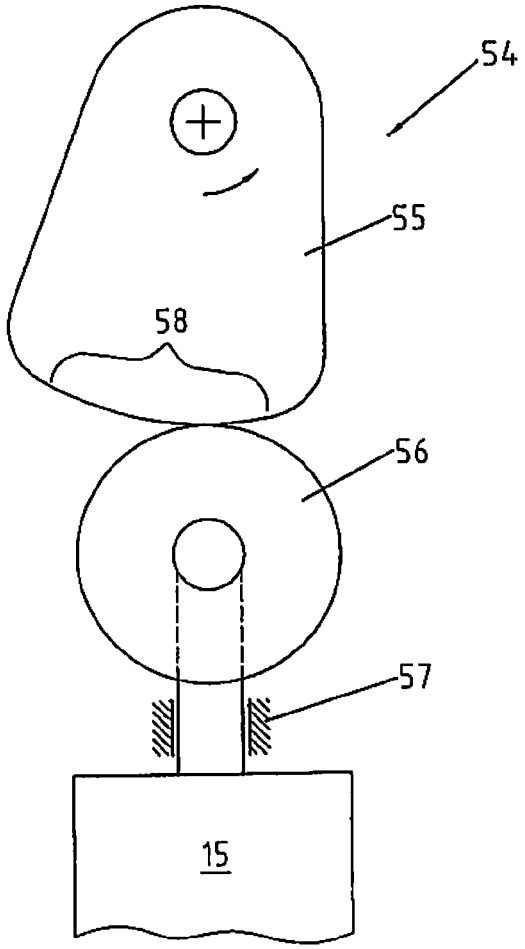
Figure 7:
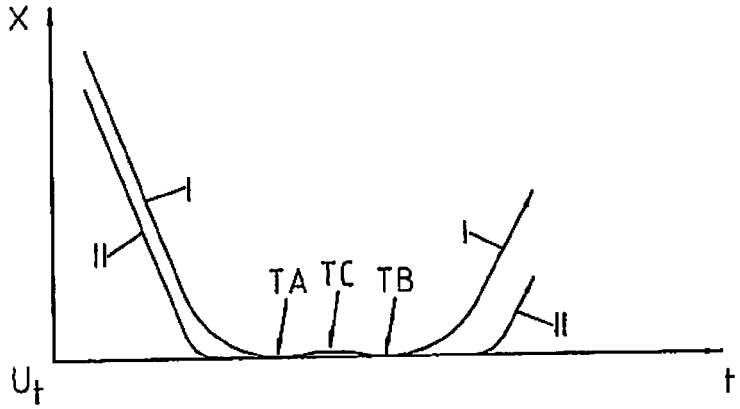

FIG. 1—a schematized representation of the drawing press, with the tool open;

FIG. 2—the press as in FIG. 1, at the start of a drawing operation;

FIG. 3—the press as in FIG. 1, at the completion of a drawing operation;

FIG. 4—a schematized representation of a modified embodiment of the drawing press in accordance with the invention;

FIG. 5—a modified drive that can act as the ram drive or, alternatively, also as the table drive, in the drawing press in accordance with the invention;

FIG. 6—another modified drive that can act as the ram drive in the drawing press in accordance with the invention;

FIG. 7—distance vs. time curves of the ram drive.

DETAILED DESCRIPTION OF THE INVENTION

FIG. 1 shows a drawing press 10 that can be used for the manufacture of large sheet metal components, for example, vehicle body parts. The drawing press 10 comprises a press frame that is supported by at least one, preferably several, vertically oriented stands 11, 12, a head 13, said head being supported by the stands 11, 12, and by a pedestal 14 that is located under or between the stands 11, 12. The head 13, the stands 11, 12 and the pedestal 14 form a closed frame. In said frame, a ram 15 is supported so as to be linearly movable, e.g., in vertical moving direction 16. Linear guides 17 provided on the stands 11, 12, for example, are disposed for bearing the ram 15.

The ram 15 is disposed for the accommodation of an upper tool component that is configured as the matrix tool 18. Said ram is shown in a sectional view in FIG. 1 and has a rim 19 that is disposed for clamping and holding in place the rim of a workpiece during the drawing operation. The workpiece is a blank 20, i.e., an initially plane metal sheet. The rim 19 circumscribes the hollow space 21 of the tool into which the workpiece is to be formed.

A ram drive 22 is disposed for driving the ram 15, said ram drive comprising one or also more servomotors 23, 24 that are connected with the ram 15 via one or more gear mechanisms 25, 26. The two gear mechanisms 25, 26 are coupling gear mechanisms of a suitable design. In the present exemplary embodiment, eccentric gear mechanisms designed so as to be mirror-symmetrical with respect to each other are used as an example. Each of said eccentric gear mechanisms comprises an eccentric 27, 28 that is coupled with the ram 15 via an eccentric rod 29, 30.

Furthermore, the drawing press 10 comprises a press table 31 on which may be arranged a mobile table 32. In a manner known per se, the mobile table 32 is disposed for the change of tools. The mobile table 32 carries the lower tool part that comprises a tool support 33 with a punch tool 34 arranged thereon, and a blank holder 35. The punch tool 34 is a male mold whose upper contour matches the hollow space 31. In most cases, this male mold is enclosed by the rectangular blank holder 35, in which case the blank holder 35 and the punch tool 34 can be moved relative to each with respect to the moving direction 16.

The unit comprising the punch tool 34, the tool support 33, the mobile table 32 and the press table 31 is seated on a table drive 36 that can be moved in moving direction 16 (see the appropriate arrow) in the direction toward the ram 15 and away from said ram. The press table 31 and its table drive 36, respectively, can be linearly moved in moving direction in the press frame on the stands 11, 12 and/or on the pedestal 14 by means of guide arrangements. The table drive 36 comprises one or more gear mechanisms 38, 39 that are configured—like the gear mechanisms 25, 26—as coupling gear mechanisms. They comprise a blocking position. For example, they are configured as eccentric gear mechanisms that bring the press table 31 into driving connection with one or more servomotors 40, 41. Each of the gear mechanisms 38, 39 comprises an eccentric 42, 43 that is connected with the press table 31 via an eccentric rod 44, 45.

Via suitable abutment elements, for example in the form of setbolts 46, the blank holder 35 abuts against an abutment 47. In the simplest case, the abutment 47 may be arranged stationarily relative to the pedestal 14. Alternatively, said abutment may be in connection with an adjustment device 48 that is able to adjust the position of the abutment 47 relative to the moving direction 16, for example. Usually, this is accomplished in load-free state. However, the adjustment device 48 can also be configured in such a manner that it can adjust the abutment 47 under load, for example in order to affect or regulate the force acting on the blank holder 35 and thus on the drawing edge of the workpiece, in a targeted manner. The adjustment device 48 may be hydraulic cylinders, toggle mechanisms, spindle-type lifting gears or the like. Linear guides 49 may be provided between the abutment 47 and the table drive 36, said linear guides being oriented in moving direction 16.

The in so far described drawing press 10 operates as follows:

First, the drawing press 10 is in open position. To do so, the ram 15 is moved into an upper position by an appropriate rotation of the eccentrics 27, 28. The press table 31 is moved into a lower position by an appropriate rotation of the eccentrics 42, 43. Consequently, the punch tool 34 projects slightly or not slightly beyond the blank holder 35. An essentially flat blank 20 can be placed on the blank holder 35.

As soon as the workpiece transport means such as, for example, feeders, suction spiders or other grippers, these not being specifically shown here, have been moved out of the tool space it is possible for the tool to close. To do so, the drawing press 10 is moved into the position depicted by FIG. 2. The servomotors 23, 24 that are not specifically shown here have moved the eccentrics 27, 28 far enough that the ram 15 reaches its lower reversal point $U_t$ for the first time. Just before reaching the lower reversal point Ut, the rim 19 of the matrix tool 18 is seated on the rim of the blank 20 and starts to press said blank against the blank holder 35. Via the abutment elements 46, the blank holder 35 rests in an unyielding manner on the abutment 47, so that now the press frame is tensioned in moving direction 16. Interacting with the adjusted position of the blank holder 35, the spring constant of said press frame determines the clamping force acting on the rim of the blank in a highly precise manner.

Once the lower reversal point $U_t$ of the ram 15 and thus the tensioned position of the matrix tool 18 has been reached at a point in time TA (FIG. 7, curve I), the servomotors 23, 24 are completely, or at least partially, load-free. The blank holding force is supported by the head 13 via the eccentric rod arrangement of the gear mechanism 25 and 26 that is in extended position. No energy is used for maintaining the holding force acting on the rim of the blank 20. In addition, there is no energy exchange between the ram drive and any drawing cushion.

As they approach the reversal point $U_t$ the servomotors 23, 24 begin to decelerate, move through the reversal point $U_t$ and then stop, as can be inferred from the diagram of FIG. 7, curve I. Thus, the ram 15 performs a barely noticeable movement away from the reversal point $U_t$ after having moved through the point in time TA. The servomotors 23, 24 then stop at the point in time TC and immediately, or shortly thereafter, reverse their direction of rotation in order to again move through the reversal point $U_t$. This takes place at the point in time TB. Preferably, the gear mechanisms 38, 39 reach their extended positions exactly at this point, thus marking the completion of the drawing operation. From hereon in, the opening movement of the matrix tool 18 begins in that said matrix tool moves away from the reversal point $U_t$ with the servomotors 23, 24 already rotating, said servomotors having already been pre-accelerated in the section of time between TC to TB. Therefore, the opening of the tool occurs very rapidly, i.e., at least more rapidly that would be the case if the servomotors were still at a standstill at the point in time TB.

The same also applies already to the closing of the tool. The deceleration of the servomotors when the ram position is approaching the reversal point $U_t$ may occur delayed, relatively speaking, so that—despite the potentially full deceleration power at point TA—a stand-still of the motor is still not reached at point TA but only at point TC.

Starting with the state at the point in time TA, the actual drawing operation is initiated via TC toward TB, the end of said operation being illustrated in FIG. 3. In order to perform the drawing operation, the servomotors 40, 41 are activated so that the eccentrics 42, 43 with their eccentric rods 44, 45 move into extended position and thus reach the top dead center of the table drive 36. In it, the punch tool 34 has been moved fully upward into the matrix tool 18. When the extended position is being approached, the gear reduction between the servomotors 41, 42 and the press table 31 moves toward infinite, so that the punch tool 34 is able to apply very high pressures to the workpiece.

In continuation, the tool comprising the matrix tool 18 and the punch tool 34 is opened again after the point TB in that—while the blank holder 35 continues to be at rest—the ram 15 is being moved upward and the press table 31 is being moved downward.

FIG. 4 shows a schematized representation of a modified embodiment of the drawing press in accordance with the invention. The so far described drawing press 10 offers a concept that is suitable for the continued use of drawing tools that, until now, have been used in presses comprising drawing cushions located at the bottom. To do so, the press table 31 comprises a group of openings 61, 62, 63 which the abutment elements 46 can be optionally inserted. In so far, it is possible to use differently sized tools, said tools comprising blank holders 35 spanning different distances. This results in a geometrically variable force introduction for the blank holder 35. In addition, this offers increased latitude or convenience in tool design. The presented concept of operation comprising at least two passes of the reversal point $U_t$, in one press cycle reduces the cycle time and increases the stroke rate and the output. Considering the presented press concept, numerous modifications are possible while maintaining the basic principle. For example, the ram 15 may be moved by the gear mechanisms 25, 26 in a drawing manner when the servomotors 23, 24 are arranged on the pedestal 14.

Furthermore, the press table 31 in this as well as in all other embodiments can be driven by a single servomotor 40 if the toothed wheels of the eccentrics 42, 43 mesh with each other or if the eccentrics 42, 43 are connected to each other in another manner by suitable gear means. In addition, the eccentrics 42, 43 can optionally be configured as full circle wheels. This measure can also be used in the eccentrics 27, 28 and their toothed wheels, respectively.

Furthermore, FIG. 5 shows a driving arrangement that can optionally be used as the ram drive 22, as well as the table drive 36. This drive also comprises a rest position when its connecting rods 52, 53 are in extended position. In this extended position, a rotation of the driving servomotor 23, 24 (or, correspondingly, 40, 41) does not effect any—or only an extremely minimal—linear adjustment of the connected member, for example the ram 15. Forces acting thereon are supported in a straight line through the connecting rods 52, 53 on the machine frame, without loading the servomotors.

FIG. 6 is a schematic representation of a gear mechanism 22 that is configured as a cam mechanism 54. Said mechanism also comprises a cam disk 55 driven by a servomotor 23 and comprises a cam follower 56, e.g., in the form of a roller following the cam circumference, and thus performs a linear back and forth movement that is prespecified by the different radii of the cam disk. To do so, the cam follower 56 is guided in a linear guide 57 and connected to the ram 15. The cam mechanism can produce the motion curve II of FIG. 7. For example, the cam disk 55 has one section 58 with a constant radius. This radius defines the reversal point $U_t$.

The above provided functional description applies, accordingly to the function of a press comprising this cam mechanism 54. In addition, the following applies: The servomotor 23 can be operated so as to be reversible and, alternatively, also so as to be continuously moving. Then the ram 15 moves into the reversal point $U_t$ and assumes this position at the point in time TA, the point in time TB and, optionally, the additional point in time, e.g., between TA and TB. In this phase, the blank holding force need not be provided by the rotating servomotor because—due to the constant radius of the cam disk in section 58—the forces acting on the ram 15 do not generate any torque. Depending on the design of the cam disk 55, the servomotor 23 can be operated at a constant rotational speed, at varying rotational speeds, with a constant direction of rotation or with changing directions of rotation. Also in this case no time is required for decelerating and accelerating the servomotor before and after the drawing operation. As has already been the case in the previous example using the eccentric gear mechanism, these acceleration phases can be moved into the time period of the drawing operation. Alternatively, at least in the embodiment of FIG. 6, it is possible to partially or completely dispense with the accelerating and decelerating operations.

The drawing press (10) according to the invention has for driving its ram (15) a directionally reversing gear mechanism (22, 54), for example a coupling gear mechanism, and at least one servomotor (23). The servomotor (23) passes through the reversal point ($U_t$) of the ram movement, which is predetermined by the kinematics of the coupling gear mechanism, for example the extended position of an eccentric drive. During the closing of the die (18), that is to say during a press stroke, the servomotor (23) is activated in such a way that it first passes through this reversal point ($U_t$), then stops, reverses and then passes through it once again, in order to open the die (18) again. Consequently, the braking to a standstill and re-acceleration of the servomotor for the upper ram (15) takes place while the actual drawing operation is still or already being performed, i.e. during the forming of the metal blank, which significantly reduces the cycle time.

LIST OF REFERENCE SIGNS

10 Drawing press
11, 12 Stand
13 Head
14 Pedestal
15 Ram
16 Moving direction
17 Linear guide
18 Matrix tool; die
19 Rim
20 Blank
21 Chamber
22 Ram drive
23, 24 Servomotor
25, 26 Gear mechanism
27, 28 Eccentric
29, 30 Eccentric rod
31 Press table
32 Mobile table
33 Tool base plate
34 Punch tool
35 Blank holder
36 Table drive
37 Linear guide
38, 39 Gear mechanism
40, 41 Servomotor
42, 43 Eccentric
44, 45 Eccentric rod
46 Abutment elements
47 Abutment
48 Adjustment device
49 Linear guide
61, 62, 63 Openings
52, 53 Connecting Rod
54 Cam mechanism
55 Cam disk
56 Cam follower
57 Guide
58 Section

I claim:

1. Drawing press (10) comprising:

a press frame, a ram (15) provided for accommodating a matrix tool (18) for deforming a blank (20), said ram (15) being supported in a manner so as to be adjustable in an adjustment direction (16), the matrix tool (18) comprising a rim (19) for contacting a rim of the blank (20) and a lower contour into which the blank (20) is to be deformed, a blank holder (35) opposite the ram (15), said bank holder abutting against an abutment (47) and configured to cooperate with the rim (19) of the matrix tool (18) to clamp the rim of the blank;

a ram drive (22) comprising at least one servomotor (23) connected to the ram via a coupling gear mechanism (25) or a cam mechanism (54), said coupling gear mechanism or cam mechanism having a reversal point ($U_t$) corresponding to a lower dead center position of said ram (15) resulting in the rim (19) of the matrix tool (18) clamping the rim of the blank against the blank holder, a table (31) for accommodating a punch tool (34) with an upper contour for cooperating with the lower contour of the matrix tool (18) for deforming the blank (20), said table being associated with a table drive (36) in order to move said table back and forth in the adjustment direction (16), wherein the ram (15) in accordance with the ram drive (22) is configured to:

(1) in a single press stroke with the at least one servomotor (23) running and the matrix tool (18) closed to clamp the rim of the blank (20) against the blank holder (35), passes the reversal point ($U_t$) at least in two chronologically spaced apart points in time TA and TB;

(2) in a single press stroke a directional reversal of the ram (15) is performed between the points in time TA and TB via the at least one servomotor (23); and, (3) in a single press stroke the ram (15) is lifted from the reversal point ($U_t$) by a small amount with the matrix tool (18) still closed until the at least one servomotor (23) is reversed at a point of time TC located between the points in time TA and TB and then moves downward again in order to pass the reversal point ($U_t$) of the second point of time TB;

wherein the ram drive (22) is configured to in a single press stroke to not stop the at least one servomotor (23) at the points of time TA and TB, but the at least one servomotor (23) continues to rotate and decelerates after the ram (15) has passed through the reversal point ($U_t$) at time TA and accelerates at the point of time TC before the ram (15) passes the reversal point ($U_t$) at time TB; and wherein the table drive (36) assigned to the punch tool (34) is configured to start when the reversal point ($U_t$)

of the ram (15) and the matrix tool (18) is reached for the first time, the punch tool (34) in accordance with the table drive (36) is configured in a single press stroke to perform a drawing operation of the blank (20) between the points in time TC and TB and not between the points of time TA and TB.

2. Drawing press as in claim 1, characterized in that the coupling gear mechanism is an eccentric gear mechanism.

3. Drawing press as in claim 1, characterized in that the abutment (47) is stationarily arranged on the press frame.

4. Drawing press as in claim 1, characterized in that the abutment (47) and the rain (15) are arranged so as to be resilient relative to each other.

5. Drawing press as in claim 1, characterized in that the abutment (47) is associated with an adjustment drive (48) in order to regulate the blanking holding force.

6. Drawing press as in claim 1, characterized in that the table drive (36) comprises a gear mechanism (25, 38) with at least one rest position in which the gear mechanism does not transfer movement to the table.

7. Drawing press as in claim 6, characterized in that the gear mechanism (25, 38) for the table drive (36) is a coupling gear mechanism.

8. Drawing press as in claim 7, characterized in that the coupling gear mechanism is an eccentric gear mechanism.

9. Drawing press as in claim 8, characterized in that the table drive (36) comprises at least one servomotor (40, 41) that is configured to go in reverse.

10. Drawing press as in claim 9, characterized in that the table drive (36) comprises an eccentric gear mechanism whose eccentric (42) is configured to move through an angle of rotation smaller than 90 degrees during one press stroke.

11. Drawing press as in claim 1, characterized in that the press frame comprises a head (13), a table (31) and interposed stands (11, 12).

12. A method for deep-drawing a sheet metal part, in particular a vehicle body part, with the use of a drawing press (10) comprising a ram (15) for the accommodation of a matrix tool (18), said matrix tool (18) comprising a rim (19) for contacting a rim of the sheet metal part (20) and a lower contour into which the sheet metal part (20) is to be deformed, a blank holder (35) opposite the ram (15), said bank holder abutting against an abutment (47) and configured to cooperate with the rim (19) of the matrix tool (18) to clamp the rim of the sheet metal part (20); said ram being movable between an open position and a closed position using a ram drive (22) comprising at least one servomotor (23) connected to the ram via a coupling gear mechanism (25) or a cam mechanism (54), said coupling gear mechanism or cam mechanism having a reversal point $U_t$ corresponding to a lower dead center position of the ram (15) resulting in the rim (19) of the matrix tool (18) clamping the rim of the sheet metal part (20) against the blank holder (35), wherein the ram (15) reaches and passes through its lower dead center position defining the closed position, wherein a servomotor driving said ram is decelerated and reversed after passing through the reversal point $U_t$ in order to move the ram (15) after its renewed passage through the dead center position, again into its open position through the reversal point $U_t$;

wherein the servomotor (23) performs a directional reversal of the ram (15) between points in time TA and TB defining two chronologically spaced apart points in time when the ram (15) passes through the reversal point $U_t$ during a single press stroke of the ram (15) with the servomotor (23) running and the matrix tool (18) closed to clamp the rim of the sheet metal part (20) against the blank holder (35), wherein the ram (15) is lifted from the reversal point $U_t$ by a small amount with the matrix tool (18) still closed until the servomotor is reversed at a point in time TC located between the points in time TA and TB and then moves downward again in order to pass the reversal point of time TB;

wherein the servomotor then accelerates the ram through the reversal point Ut of time TB; and wherein the servomotor (23) is not stopped at the points of time TA and TB, but continues to rotate and decelerates after the ram (15) has passed through the reversal point at TA and accelerates at the point of time TC before the ram has passed the reversal point at TB; and wherein a table drive assigned to a punch tool is started when the reversal point Ut of the ram and the matrix tool is reached for the first time, the punch tool in a single press stroke performing a drawing operation of the sheet metal part between the points in time TC and TB and not between the points in time TA and TB.

* * * * *